US007004127B2

(12) United States Patent
Shibata et al.

(10) Patent No.: US 7,004,127 B2
(45) Date of Patent: Feb. 28, 2006

(54) ACTUATOR HAVING DRIVE CAM AND VALVE LIFT CONTROLLER USING THE ACTUATOR

(75) Inventors: Akira Shibata, Anjo (JP); Yasuyoshi Suzuki, Chiryu (JP)

(73) Assignee: Denso Corporation, Kariya (JP)

( * ) Notice: Subject to any disclaimer, the term of this patent is extended or adjusted under 35 U.S.C. 154(b) by 139 days.

(21) Appl. No.: 10/690,664

(22) Filed: Oct. 23, 2003

(65) Prior Publication Data

US 2004/0083997 A1 May 6, 2004

(30) Foreign Application Priority Data

Oct. 30, 2002 (JP) ..... 2002-315588

(51) Int. Cl.
*F01L 1/34* (2006.01)

(52) U.S. Cl. ..... 123/90.16; 123/90.11; 123/90.18; 123/90.17; 123/90.21

(58) Field of Classification Search ..... 123/90.16, 123/90.18, 90.11
See application file for complete search history.

(56) References Cited

U.S. PATENT DOCUMENTS 6,328,006 B1 * 12/2001 Heer ..... 123/90.15
6,425,357 B1 7/2002 Shimizu et al.
6,823,826 B1 * 11/2004 Sugiura et al. ..... 123/90.16

FOREIGN PATENT DOCUMENTS

| | | |
|---|---|---|
| JP | 60-164003 | 8/1985 |
| JP | 63-182371 | 11/1988 |
| JP | 6-18999 | 1/1994 |
| JP | 7-132470 | 5/1995 |

* cited by examiner

*Primary Examiner*—Thomas Denion
*Assistant Examiner*—Kyle M. Riddle
(74) *Attorney, Agent, or Firm*—Nixon & Vanderhye P.C.

(57) ABSTRACT

An actuator is used for controlling an intake valve lift of an automotive engine. A control shaft is joined with a transmission device on its one end side, and is joined with a valve lift controller on the other end side. The control shaft is arranged perpendicularly to a spindle of a motor. Besides, the transmission device includes a drive cam internally. Thus, the actuator is reduced in size in a longitudinal direction of the control shaft regardless the length of the motor. When the motor rotates, the control shaft reciprocates in accordance with a cam profile of the drive cam. The intake valve lift can be precisely controlled by defining the cam profile, especially in a rotation range of the drive cam corresponding to the idling operation of the engine.

7 Claims, 6 Drawing Sheets

ACTUATOR HAVING DRIVE CAM AND VALVE LIFT CONTROLLER USING THE ACTUATOR

CROSS REFERENCE TO RELATED APPLICATION

This application is based on Japanese Patent Application No. 2002-315588 filed on Oct. 30, 2002 the disclosure of which is incorporated herein by reference.

BACKGROUND OF THE INVENTION

The present invention is related to an actuator for manipulating a controlled object in accordance with an axial position of a control shaft while transferring a rotation of a motor to a reciprocating motion of the control shaft, and a valve lift control system using the actuator.

1. Related Art

In an automotive engine, an actuator is used for manipulating a controlled object in accordance with an axial position of a control shaft.

According to a variable valve mechanism for an internal combustion engine in U.S. Pat. No. 6,425,357 (JP-A-2001-263015), an intermediate driving mechanism is movably supported on its axis independent of the axis of a valve cam. The intermediate driving mechanism includes a control shaft, a valve cam related part and intake valve related parts. The intermediate driving mechanism is provided for transmitting a driving force of the valve cam to an intake valve. A reciprocating motion of the control shaft is transferred into a rotation motion of the valve cam related part and a rotation motion of the intake valve related parts. Accordingly, the relative lift-difference of the valve cam related part with the intake valve related parts are controlled based on the axial position of the control shaft. Here, controlled object can be an exhaust valve instead of the intake valve.

However, the axial position of the control shaft is controlled by adjusting oil pressure in a pressure chamber. The pressure chamber is provided on one end side of the control shaft for reciprocating the control shaft. In this structure, a piston for receiving oil pressure from the pressure chamber and a housing for forming a pressure chamber are provided so as to control differential pressure between the front side of the piston and the rear side of the piston. Accordingly, controllability of a position and response is inferior.

Here, an electric actuator can be used instead of a hydraulic actuator. However, a length of the electric actuator may be elongated in the axial direction of the control shaft depending on an arrangement of a motor and the control shaft.

SUMMARY OF THE INVENTION

In view of the foregoing problems, it is an object of the present invention to propose an actuator having a small-sized body in the axial direction of the control shaft, and a valve lift controller using the actuator.

A spindle of a motor for rotating a drive cam is arranged perpendicularly to a control shaft in the actuator. Therefore, the length of the motor does not directly affect the length of the actuator in the axial direction of the control shaft. Thus, the length of the actuator can be shortened.

A spur gear is coaxially provided with the drive cam for rotating the drive cam. Two tabs are formed on both flat surfaces of the spur gear. Stoppers are separately provided on both sides of the spur gear corresponding to the positions of the convexities for locking the spur gear. Therefore, interference between the stoppers and convexities is avoided.

A transmission device including the drive cam is joined with the control shaft for transferring a rotation of the inner drive cam into a reciprocating motion of the control shaft. The transmission device is arranged so that the axis of the inner drive cam is perpendicular to the axis of the control shaft while the transmission device and the control shaft overlap each other. Therefore, a length of a joining section between the control shaft and the transmission device is shortened in the axial direction of the control shaft.

The rotation angle of the drive cam is detected by an angular sensor using a Hall element. The detection is performed without contacting, so that reliability of the angular sensor is enhanced and a life of the angular sensor can be extended.

An electromagnetic clutch is included in the actuator so as to prohibit rotation of the motor for fixing a position of the control shaft when the electromagnetic clutch is de-energized. Therefore, power consumption of the motor can be reduced if the electromagnetic clutch is used for an actuator in which a total stopping period of the controlled object is longer than a total moving period during its operation.

When an engine is idling, the angle of the drive cam is defined to be in an angle range around one end of its rotation range. Here, the rotation of the drive cam is equivalent to the lift of the intake valve.

A rate of change of the lift (lift change rate) of the intake valve while the drive cam rotates around the end of the rotation range is defined to be smaller than a lift change rate of the intake valve while the drive cam rotates in a range different from the range around the end of the rotation range. Accordingly, cam lift change rate of the drive cam decreases with respect to a rotation degree of the drive cam. Subsequently, a displacement amount of the control shaft in its reciprocating direction is reduced with respect to the rotation degree of the drive cam. Here, a displacement of the control shaft (i.e., lift of the intake valve) is detected by sensing the rotation angle of the drive cam.

Accordingly, the detection accuracy of a displacement of the control shaft is enhanced when the engine is idling. Thus, axial position of the control shaft can be precisely controlled, so that the lift of the intake valve can be precisely controlled. Here, the controlled object can be the exhaust valve instead of the intake valve.

The control shaft receives reactive force from a controlled object such as the intake valve or the exhaust valve when the control shaft controls the lift of the intake valve or the exhaust valve.

BRIEF DESCRIPTION OF THE DRAWINGS

Other objects, features and advantages of the present invention will become more apparent from the following detailed description made with reference to the accompanying drawings, in which.

DETAILED DESCRIPTION OF THE PREFERRED EMBODIMENTS (First Embodiment)

Figure 1:
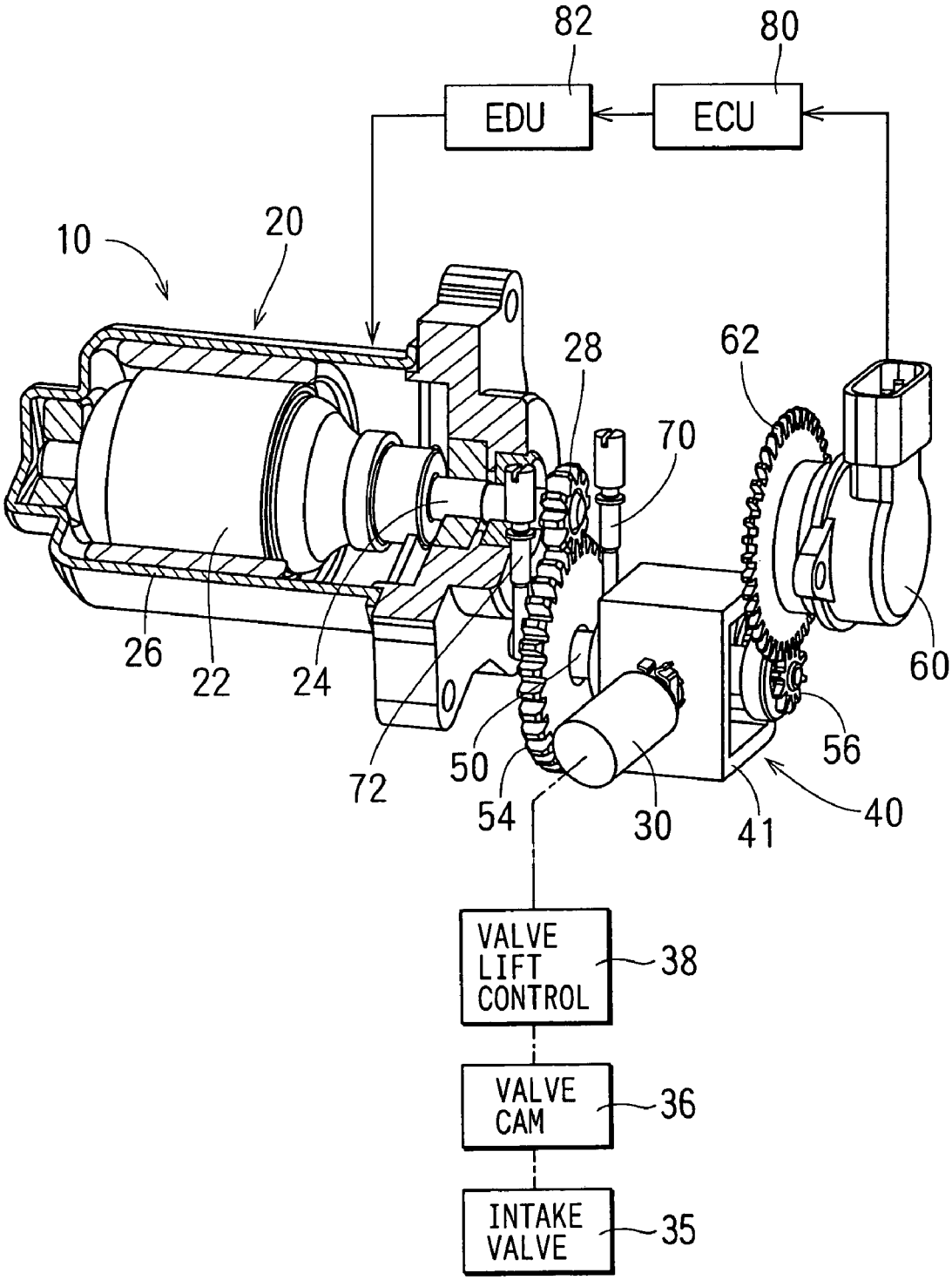
FIG. 1 is a partially cross-sectional perspective view showing an actuator according to a first embodiment of the present invention.

As shown in FIG. 1, an actuator 10 is used for actuating a valve lift controller 38 for an internal combustion engine, for example. Here, the valve lift controller 38 controls relative lift-difference between an intake valve 35 and a valve cam 36 of the engine in accordance with an axial position of a control shaft 30. The valve cam 36 opens and closes the intake valve 35.

The actuator 10 includes a motor 20, the control shaft 30, a transmission device 40, a drive cam 52 (shown in FIG. 3), an angular sensor 60, an electronic control unit (ECU) 80, and an electronic drive unit (EDU) 82. The motor 20 is a DC motor including a rotor 22 having a winding coil and magnet 26 surrounding an outer periphery of the rotor 22. A motor gear 28 is provided on the axial end of a spindle 24 of the motor 20. The spindle 24 rotates with the rotor 22.

The control shaft 30 is joined with a supporting frame 41 of the transmission device 40 on its one end, and is joined with the valve lift controller 38 on the other end. The axis of the control shaft 30 is perpendicular to the axis of the spindle 24 of the motor 20.

Figure 2:
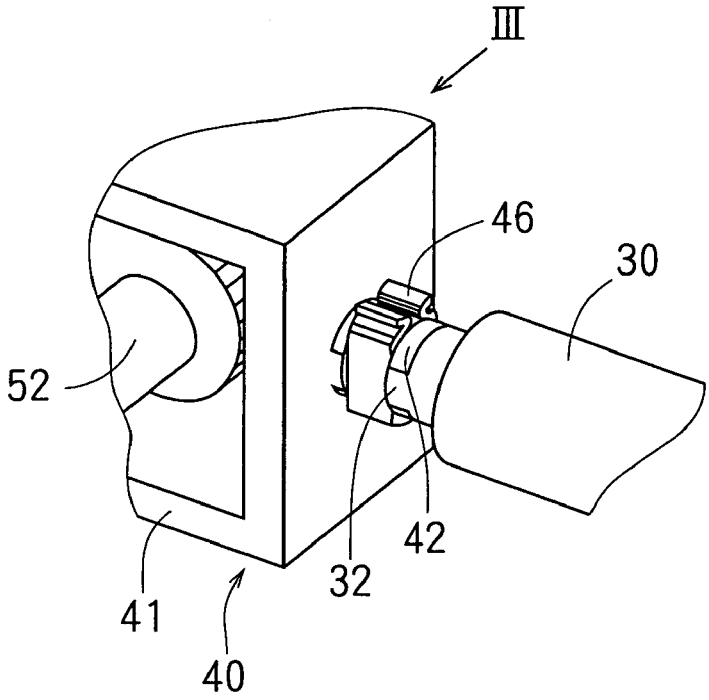
FIG. 2 is a perspective view showing a joint section between a control shaft and a transmission device according to the first embodiment.
Figure 3:
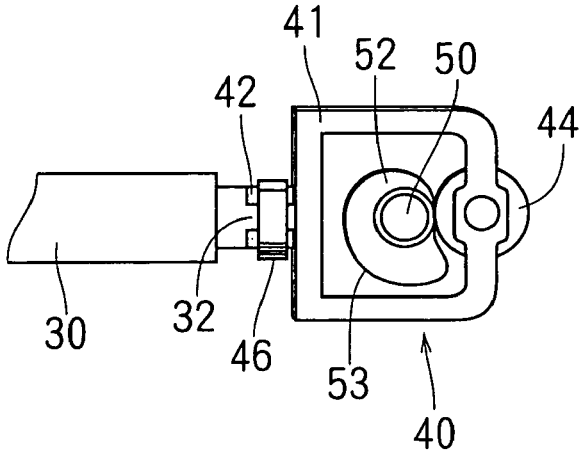
FIG. 3 is a side view from the arrow III in FIG. 2 showing the transmission device.

As shown in FIG. 2 and FIG. 3, a coupling 32 is formed at one end of the control shaft 30, and is fitted with a joint 42. The coupling 32 is joined with the joint 42 of the supporting frame 41 so that the coupling 32 and the joint 42 fit and overlap each other. A joint section between the coupling 32 and the joint 42 is coupled by a clip 46 so as to be fixed each other.

The transmission device 40 includes the box-shaped supporting frame 41 and a roller 44. A cam shaft 50 and the drive cam 52 are rotatably accommodated in the supporting frame 41. The roller 44 is rotatably supported by the supporting frame 41 on the opposite side of the control shaft 30 with respect to the drive cam 52. The drive cam 52 is rotated with the cam shaft 50, and contacts the roller 44 sliding each other. The structure of the transmission device 40 is reduced in size in the axial direction of the control shaft 30 compared with a structure in which the roller 44 and the drive cam 52 are provided outside of the transmission device 40.

Referring back to FIG. 1, cam gears 54, 56 are provided on both ends of the cam shaft 50. The cam gear 54 engages with the motor gear 28. The motor gear 28 and the cam gear 54 are spur gears, and are used as reduction gears.

Figure 4:
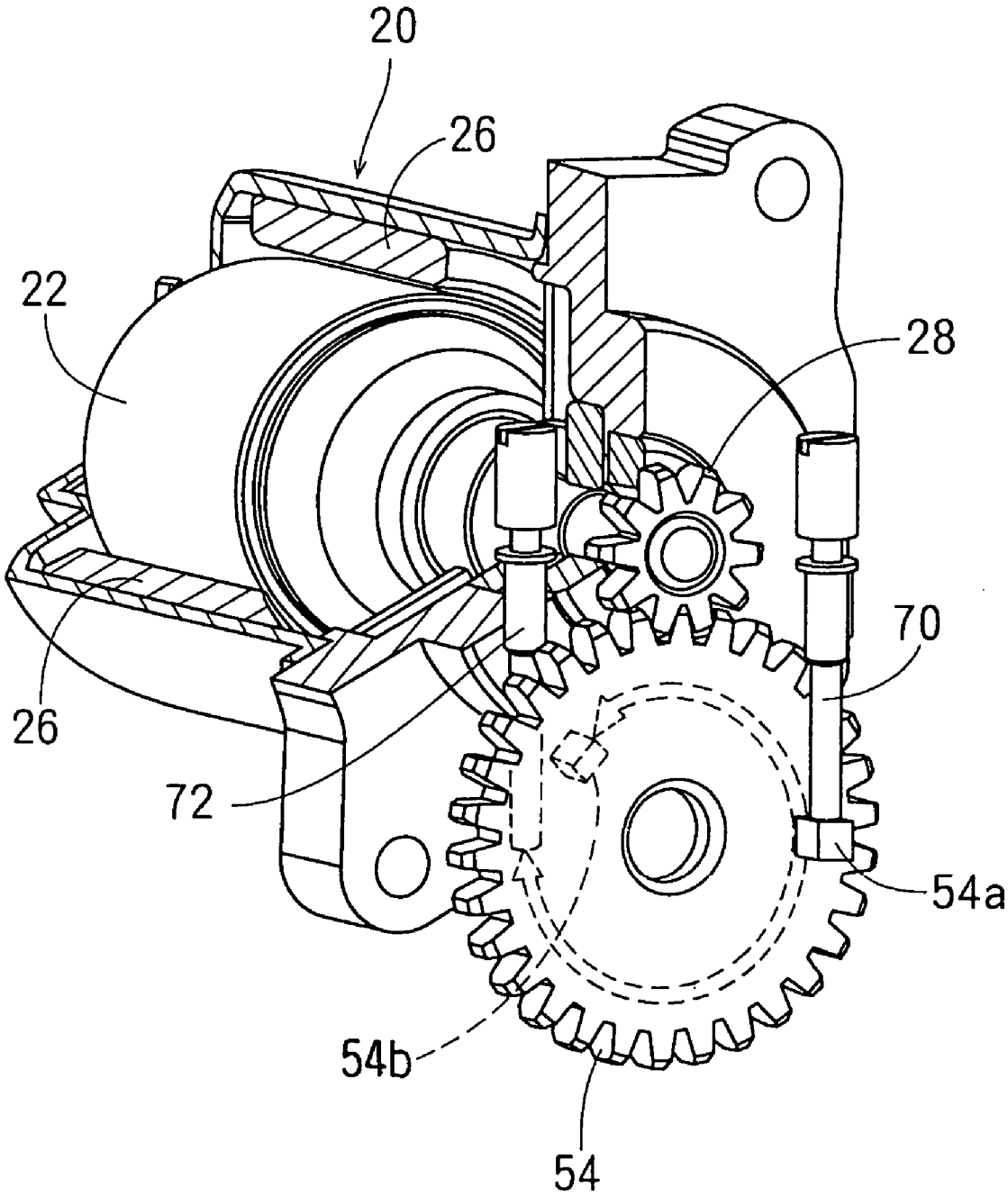
FIG. 4 is a partially cross-sectional perspective view showing convexities formed on a cam gear.

As shown in FIG. 4, a tab 54*a* is formed on one end face of the cam gear 54. A shaft 70 is provided on the housing of the motor 20, and is used as a stopper. A rotation of the motor 20 stops when the tab 54*a* is received by the shaft 70. Another tab 54*b* is formed at the second end face of the cam gear 54 on the opposite side of the tab 54*a* with respect to an axial direction of the cam gear 54. Another shaft 72 is provided on the housing of the motor 20, and is used as a stopper as well as the shaft 70. A rotation of the motor 20 stops when the tab 54*b* is received by the shaft 72. Here, the two shafts 70, 72 are separately provided so that interference between the shafts 70, 72 is avoided.

Both tabs 54*a*, 54*b* are locked by both shafts 70, 72 respectively, so that a rotation range of the drive cam 52 is defined within approximately 300°. First end of the rotation range of the drive cam 52 substantially corresponds to a lift of the intake valve 35 when the engine is idling.

Referring to FIG. 1 again, an angular sensor 60 has a sensing gear 62 engaging with the cam gear 56. A sensor object (not shown) is coaxially provided with the sensing gear 62. The angular sensor 60 detects the rotation angle of the sensor object using a non-contacting Hall element so as to detect a rotation angle of the cam shaft 50. Here, an angular sensor 60 does not contact any object, so that reliability of the angular sensor 60 is enhanced and a life of the angular sensor can be extended. A range of the rotation angle of the sensor object is restricted within 90° by setting gear ratio between the cam gear 56 and the sensing gear 62. Therefore, the range of the rotation angle of the sensor object is in a range where the Hall element can detect the rotation angle of the rotation member.

The ECU 80 inputs detection signal of the angular sensor 60, accelerator position signal and so on, and outputs control signals to the EDU 82 so as to rotate the motor 20.

Next, operation of the actuator will be now described.

When the motor 20 rotates, torque of the motor 20 is transmitted to the cam shaft 50 and the drive cam 52 (shown in FIG. 3) via the motor gear 28 and the cam gear 54.

As shown in FIG. 3, when the drive cam 52 rotates, the supporting frame 41 linearly reciprocates in the axial direction of the control shaft 30. The roller 44 supported by the supporting frame 41 rolls while sliding on the surface of the drive cam 52 so that the supporting frame 41 can move smoothly. The valve lift controller 38 controls relative lift-difference of the intake valve 35 with respect to the valve cam 36 in accordance with an axial position of the control shaft 30 which is reciprocated corresponding to a cam profile of a cam face 53 of the drive cam 52.

Figure 5:
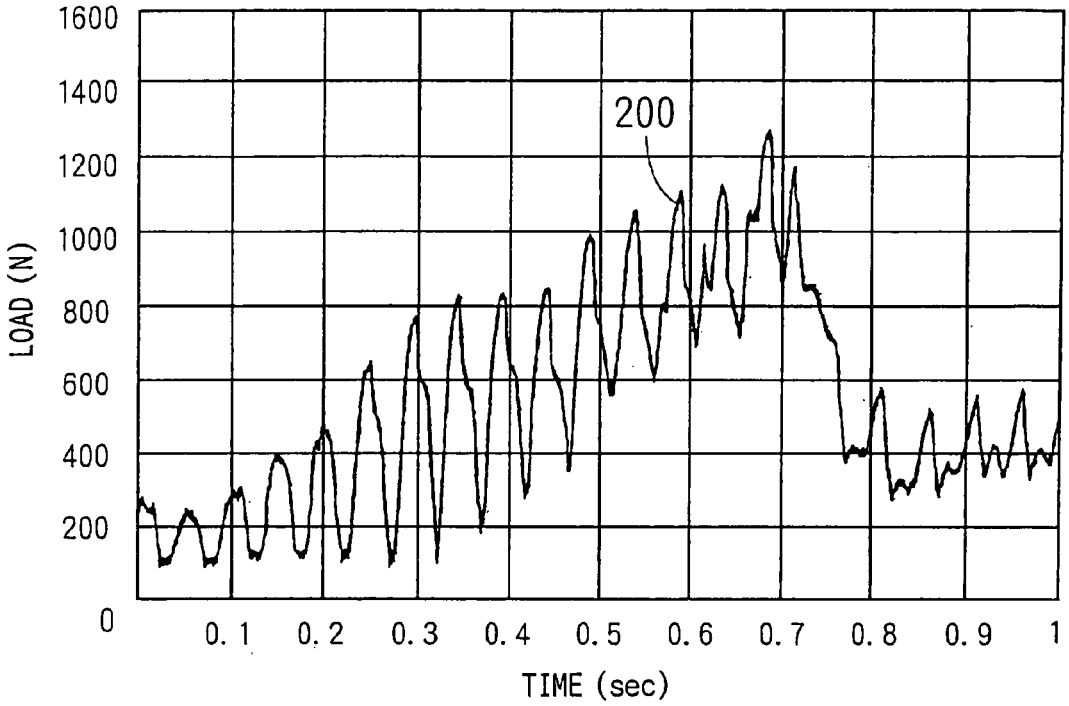
FIG. 5 is a waveform chart showing a load applied to a drive cam from a lift controller.

When the control shaft 30 controls relative lift-difference of the intake valve 35 with respect to the valve cam 36, the control shaft 30 receives a reactive force from the intake valve 35. The reactive force is shown as a load 200 in FIG. 5. The reactive force (load) changes while the drive cam 52 is rotated from the one end (first end) of its rotation range toward the other end (second end) of its rotation range, and the drive cam is stopped on the second end after approximately 0.6 sec. Each peak of the load 200 corresponds to each lift of one intake valve 35 of each of four cylinders. The load applied to the control shaft 30 from the valve lift controller 38 increases as the drive cam 52 rotates from the first end of its rotation range to the second end of its rotation range. The load decreases when the drive cam 52 is rotated to the second end of its rotation range, because the drive cam 52 does not receive reactive force from the intake valves 35 while the drive cam 52 is rotating.

When the drive cam 52 is stopped at the second end of its rotation range, the drive cam 52 receives a load higher than a load when the angle of the drive cam 52 is at the first end of its rotation range.

Figure 6:
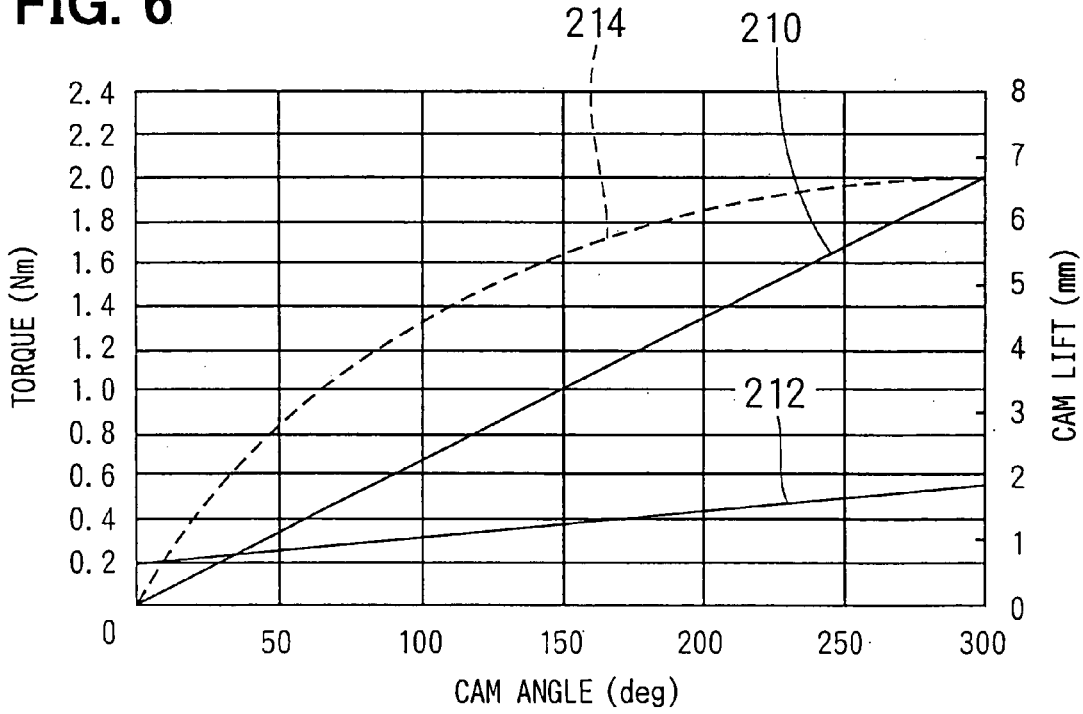
FIG. 6 is a graph showing a relation among a cam angle, a cam lift of a drive cam and torque applied to the drive cam.
Figure 7:
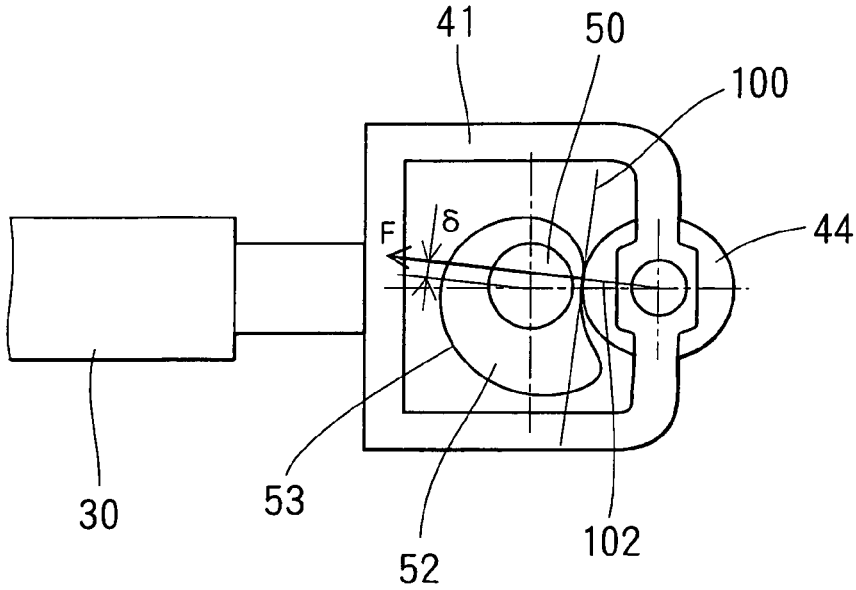
FIG. 7 is a schematic side view showing a direction of a load applied to the drive cam and arm length of the drive cam.

As shown by a straight line 210 in FIG. 6, a cam profile of the drive cam 52 is defined so that the cam lift linearly changes with respect to the cam angle of the drive cam 52. As shown in FIG. 7, an arm length δ of the drive cam 52 is defined as the distance between a normal line 102 of the drive cam 52 and the center of the cam shaft 50. In the profile shown with the straight line 210 in FIG. 6, an arm length δ of the drive cam 52 is substantially constant while the drive cam 52 rotates from the first end toward the second end of its rotation range. When the drive cam 52 receives a load that increases while the drive cam 52 rotates from the first end toward the second end of its rotation range, torque applied to the drive cam 52 from the valve lift controller 38 linearly increases as shown by a straight line 212 in FIG. 6.

On the other hand, when the drive cam 52 has another cam profile as shown by a curved line 214 in FIG. 6 where the curved line 214 is parabolic and is convex on its upper side, a rate of change of the lift (lift change rate) of the drive cam 52 once increases, subsequently decreases while the drive cam 52 rotates from the first end toward the second end of its rotation range. Referring back to FIG. 7, the normal line 102 approaches the axis of the drive cam 52 while the drive cam 52 is rotated from the first end of the rotation range toward the second end, and accordingly, the arm length of the drive cam 52 is shortened.

The load F works along a normal line 102 with respect to a tangent line 100 of the cam face 53 where the load F works. Here, the load F increases while the drive cam 52 rotates from the first end toward the second end of its rotation range. That is, the arm length δ of the drive cam 52 decreases simultaneously the load F applied to the drive cam 52 increases.

The torque applied from the valve lift controller 38 to the drive cam 52 is calculated as a product Fδ which is the product of the load F applied to the drive cam 52 and the arm length δ of the drive cam 52.

Here, the load F decreases while the arm length δ increases, Therefore, the product of the load F and the arm length δ (i.e., the torque applied to the control shaft 30 from the intake valve 35) can be substantially constant over the rotation range of the drive cam 52.

Therefore, the maximum torque applied to the drive cam 52 can be reduced. Here, torque required for the motor 20 is determined based on the maximum torque which the drive cam 52 receives from the valve lift controller 38. Therefore, the torque needed to the motor 20 can be reduced. Thus, the motor can be sized small.

The rotation angle of the drive cam 52 is equivalent to the lift of the intake valve 35. The angle of the drive cam 52 when the engine is idling is in a range where around the first end of the rotation range.

As shown by a line 216 in FIG. 8, a cam lift change rate can be defined to be small in the range around the first end of the rotation range, subsequently the cam lift change rate becomes large in a rotation range beginning at the end of the range around the first end and progressing toward the second end. In this case, a cam lift change rate of the drive cam 52 is reduced with respect to a rotation degree of the drive cam 52 around the first end of the rotation range. Accordingly, displacement amount of the control shaft 30 in its reciprocating direction is reduced while the drive cam 52 rotates around the first end. Therefore, lift change rate of the intake valve 35 is reduced with respect to the rotation degree of the drive cam 52.

The sensor 60 detects the lift change rate of the intake valve 35 by detecting the rotation degree of the drive cam 52, and the sensitivity of the angular sensor 60 is enhanced when the angle of the drive cam 52 is in the range around the first end of the rotation range. Therefore, the lift of the intake valve 35 can be precisely controlled when the engine is idling in that the rotation speed of the engine is low.

Figure 8:
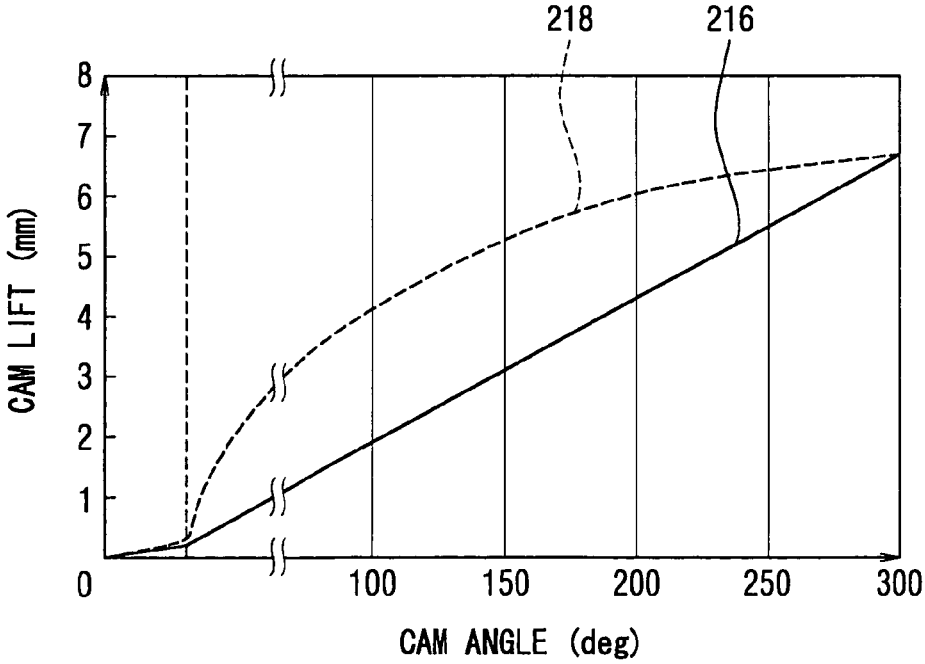
FIG. 8 is a graph showing a relation between a cam angle and a cam lift of a drive cam.

The drive cam 52 may have another cam profile as shown by a curved line 218 in FIG. 8, where the curved line 218 is parabolic and is convex on its upper side, the lift change rate is small around the first end of the rotation range compared with that in the rotation range different from around the first end. In this case, the lift of the intake valve 35 can be precisely controlled when the engine is idling. Further, a maximum torque applied to the drive cam 52 can be reduced.

(Second Embodiment)

Figure 9:
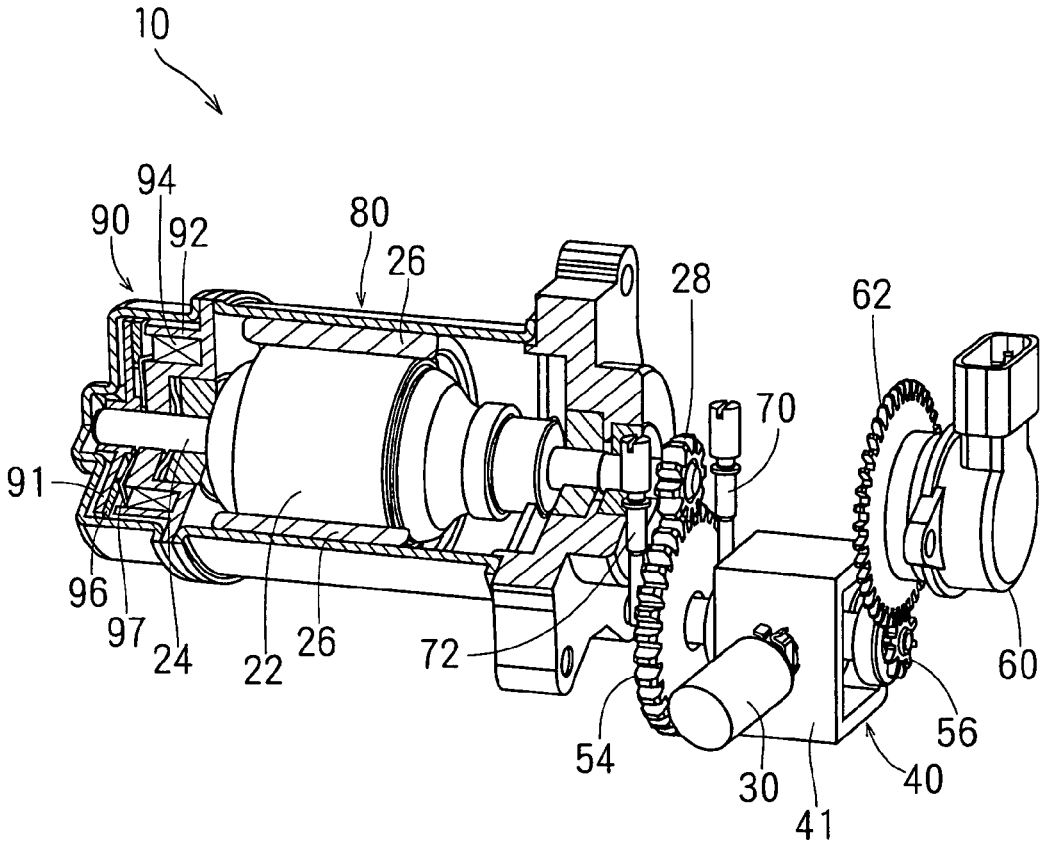
FIG. 9 is a partially cross-sectional perspective view showing an actuator according to a second embodiment of the present invention.

As shown in FIG. 9, an electromagnetic clutch 90 is provided on the motor 80 on the opposite end side of the motor gear 28 with respect to the spindle 24. The electromagnetic clutch 90 includes a rotating plate 91, a stator 92, a coil 94, an armature 96 and a blade spring 97. The rotating plate 91 is press-inserted onto the spindle 24 so as to be rotated with the spindle 24. The armature 96 is pressed onto the rotating plate 91 by the blade spring 97 when the coil 94 is de-energized. The blade spring 97 is partly locked by the stator 92. The rotation of the spindle 24 is restricted by friction between the armature 96 and the rotating plate 91 when the armature 96 is pressed onto the rotating plate 91 by the blade spring 97. That is, a rotation of the motor 80 is stopped when the coil 94 is de-energized. The armature 96 is pulled toward the stator 91 against pressing force of the blade spring 97 when the coil 94 is energized, so that the armature 96 is departed from the rotating plate 91. Thus, the spindle 24 is released from the restricted condition.

When the actuator 10 is used for actuating a valve lift controller, a period while the control shaft 30 is stopped is longer than a period while the control shaft 30 is reciprocating. That is, a period while the lift of the intake valve 35 is fixed is longer than a period while the lift of the intake valve 35 is being changed. When the coil 94 of the electromagnetic clutch 90 is de-energized, a rotation of the motor 80 is stopped so that reciprocating motion of the control shaft 30 is stopped, subsequently the lift of the intake valve 35 is fixed. While the lift of the intake valve 35 is fixed, electrical power supply is not needed. Therefore, electrical power supply for controlling the lift of the intake valve 35 can be reduced.

A one way clutch and a friction plate can be used for a clutch mechanism of the electromagnetic clutch. Here, the one way clutch is rotatable in its both rotation directions while it is energized. On the other hand, the one way clutch is rotatable in one direction, where such as opposite direction of reactive force of a lift control shaft of the air intake valve, while it is de-energized. The friction plate is rotatable in its both directions while it is energized. On the other hand, friction plates are connected for generating friction, which is less than driving power of the motor 80 in its both directions, while it is de-energized. In this case, the driving power of the motor 80 can rotate even if the clutch is connected, while decreasing power supply to the motor 80 when the lift control shaft of the air intake valve is fixed. If this friction plate is used, the friction plate can be constantly connected without using the electromagnetic clutch.

The drive cam 52 can directly manipulate the supporting frame 41 for reciprocating the control shaft 30 without using the roller 44. Additionally, the drive cam 52 can directly manipulate the control shaft 30 while sliding each other.

The actuator 10 can be used for a valve lift control apparatus for controlling a lift of an exhaust valve instead of a lift of an intake valve 35.

The actuator 10 can be used for any other structures, in that manipulation amount is controlled in accordance with an axial position of the control shaft of the actuator according to the present invention.

Other various changes and modifications are to be understood as being within the scope of the present invention as defined by the appended claims.

What is claimed is:

1. An actuator apparatus for manipulating a controlled object, the actuator comprising:

a motor having a spindle;

a control shaft actuated by the spindle, wherein the control shaft reciprocates in its axial direction so as to determine a manipulating amount of the actuator apparatus depending on an axial position thereof;

a drive cam having a rotation axis parallel with an axis of the spindle of the motor, wherein the rotation axis of the drive cam is perpendicular to an axis of the control shaft so that the drive cam reciprocates the control shaft perpendicularly to the axis of the spindle of the motor in accordance with a profile of a peripheral surface of the drive cam while the drive cam rotates; and a reduction section using a spur gear for transmitting torque of the motor to the drive cam.

2. An actuator apparatus according to claim 1, further comprising:

stoppers respectively provided on both sides of the spur gear with respect to an axial direction of the spur gear; and protrusions respectively formed on both sides of the spur gear with respect to an axial direction of the spur gear, each protrusion is respectively received by corresponding stopper for defining a rotation range of the spur gear, wherein:

the spur gear coaxially rotates with the shaft of the drive cam;

a rotation angle of the drive cam is restricted at one end of the rotation range of the spur gear and at the other end of the rotation range of the spur gear.

3. An actuator apparatus for manipulating a controlled object, the actuator comprising:

a motor having a spindle;

a control shaft actuated by the spindle, wherein the control shaft reciprocates in its axial direction so as to determine a manipulating amount of the actuator apparatus depending on an axial position thereof;

a drive cam having a rotation axis parallel with an axis of the spindle of the motor, wherein the rotation axis of the drive cam is perpendicular to an axis of the control shaft so that the drive cam reciprocates the control shaft perpendicularly to the axis of the spindle of the motor in accordance with a profile of a peripheral surface of the drive cam while the drive cam rotates;

a transmission device joined with the control shaft overlapping each other where the axis of the drive cam is arranged perpendicularly to an axis of the control shaft; and a sliding member included in the transmission device with the drive cam, wherein the sliding member and the drive cam transfers the rotation of the drive cam into a reciprocating motion of the control shaft while contacting and sliding each other.

4. An actuator apparatus for manipulating a controlled object, the actuator comprising:

a motor having a spindle;

a control shaft actuated by the spindle, wherein the control shaft reciprocates in its axial direction so as to determine a manipulating amount of the actuator apparatus depending on an axial position thereof;

a drive cam having a rotation axis parallel with an axis of the spindle of the motor, wherein the rotation axis of the drive cam is perpendicular to an axis of the control shaft so that the drive cam reciprocates the control shaft perpendicularly to the axis of the spindle of the motor in accordance with a profile of a peripheral surface of the drive cam while the drive cam rotates; and an angular sensor using a Hall element for detecting a rotation angle of the drive cam without contacting, wherein:

a detection range of the rotation angle of the drive cam is less than 90°.

5. An actuator apparatus disposed in an engine for manipulating a valve lift comprising:

An actuator for manipulating a controlled object, the actuator including:

a motor having a spindle;

a control shaft actuated by the spindle, wherein the control shaft reciprocates in its axial direction so as to determine a manipulating amount of the actuator apparatus depending on an axial position thereof; and a drive cam having a rotation axis parallel with an axis of the spindle of the motor, wherein the rotation axis of the drive cam is perpendicular to an axis of the control shaft so that the drive cam reciprocates the control shaft perpendicularly to the axis of the spindle of the motor in accordance with a profile of a peripheral surface of the drive cam while the drive cam rotates;

a valve cam for opening and closing one of an intake valve and an exhaust valve of the engine; and a lift controller for controlling one of a lift of an intake valve and a lift of an exhaust valve by adjusting the valve cam in accordance with an axial position of the control shaft.

6. An actuator apparatus according to claim 5, wherein:

the drive cam has a rotation range, wherein a vicinity of one end of the rotation range corresponds to a lift of one of the intake valve and a lift of the exhaust valve when the engine is idling;

the drive cam has a cam lift which determines reciprocating amount of the control shaft, wherein a rate of change of the cam lift varies while the drive cam rotates in the rotation range; and the drive cam has a profile, wherein a rate of change of the cam lift while the drive cam rotates in a rotation range around one end of the rotation range is smaller than a rate of change of the cam while the drive cam rotates in a rotation range beginning at the end of the range around the one end and progressing toward the other end of the rotation range.

7. An actuator apparatus according to claim 5, wherein:

the drive cam has a rotation range, wherein a vicinity of one end of the rotation range corresponds to a lift of one of the intake valve and a lift of the exhaust valve when the engine is idling;

the drive cam has a cam lift which determines reciprocating amount of the control shaft, wherein a rate of change of the cam lift varies while the drive cam rotates in the rotation range; and the drive cam has a profile, wherein a rate of change of the cam lift once increases, subsequently decreases while the drive cam rotates from one end of the rotation range toward the other end of the rotation range.

* * * * *